US009995085B2

(12) United States Patent
Perez

(10) Patent No.: US 9,995,085 B2
(45) Date of Patent: Jun. 12, 2018

(54) DOWNHOLE MOTOR STATOR AND METHOD OF MANUFACTURE

(71) Applicant: Balthazar L. Perez, Houston, TX (US)

(72) Inventor: Balthazar L. Perez, Houston, TX (US)

( * ) Notice: Subject to any disclaimer, the term of this patent is extended or adjusted under 35 U.S.C. 154(b) by 575 days.

(21) Appl. No.: 14/464,437

(22) Filed: Aug. 20, 2014

(65) Prior Publication Data

US 2015/0078947 A1 Mar. 19, 2015

Related U.S. Application Data

(60) Provisional application No. 61/879,984, filed on Sep. 19, 2013.

(51) Int. Cl.

| | |
|---|---|
| ***F04C 2/00*** | (2006.01) |
| ***F04C 13/00*** | (2006.01) |
| ***F04C 2/107*** | (2006.01) |
| ***E21B 4/02*** | (2006.01) |
| ***F03C 2/08*** | (2006.01) |

(52) U.S. Cl.

CPC ..... *E21B 4/02* (2013.01); *F03C 2/08* (2013.01); *F04C 2/1071* (2013.01); *F04C 13/008* (2013.01); *F04C 2230/60* (2013.01); *F04C 2240/70* (2013.01); *Y10T 29/49242* (2015.01)

(58) Field of Classification Search

CPC ..... F01C 1/10; F04C 18/10; F04C 2230/60; F04B 39/14; B23F 15/08; B23P 15/00

See application file for complete search history.

(56) References Cited

U.S. PATENT DOCUMENTS

| | | | | |
|---|---|---|---|---|
| 7,396,220 B2 * | 7/2008 | Delpassand | ..... | F04C 2/1075 418/153 |
| 2010/0284842 A1 * | 11/2010 | Jager | ..... | F04C 2/1075 418/48 |

* cited by examiner

*Primary Examiner* — Mark Laurenzi
*Assistant Examiner* — Anthony Ayala Delgado
(74) *Attorney, Agent, or Firm* — David G. Henry, Sr.

(57) ABSTRACT

A method for producing modular down hole, hydraulic motor components involving the formation of replaceable stator slugs to be collectively housed within a stator housing to form a stator assembly, including, in some embodiments, replaceable lobe components for the stator slugs for altering the interference with a selected rotor for such motor.

7 Claims, 5 Drawing Sheets

DOWNHOLE MOTOR STATOR AND METHOD OF MANUFACTURE

BACKGROUND OF THE INVENTION

1. Field of the Invention

The present invention relates to down hole tools and equipment used in oil and gas production.

2. Background Information

The idea of down hole motors for driving an oil well drill bit is more than one hundred years old. Modern down hole motors are powered by circulating drilling fluid (known in the industry as mud) that also acts as a lubricant and coolant for the drill bit. FIG. 1 shows a conventional state-of-the-art down hole motor assembly.

The drilling assembly 10 generally includes a rotatable drill bit 12, a bearing/stabilizer section 14, a transmission section 16 which may include an adjustable bent housing (for directional drilling), a motor power section 18, and a motor dump valve 20. The bent housing 16 and the dump valve 20 are not essential parts of the down hole motor assembly. The bent housing is only used in directional drilling. The dump valve 20 is used to allow drilling fluid to enter the motor as it is lowered into the borehole and to allow drilling fluid to exit the motor when it is pulled out of the borehole. The dump valve also shuts the motor off when the drilling fluid flow rate drops below a threshold. During operation, drilling fluid pumped through the drill string (not shown) from the drilling rig at the earth's surface enters through the dump valve 20, passes through the motor power section 18 and exits the drilling assembly 10 through the drill bit 12.

Prior art FIGS. 2 and 3 show details of the power section 18 of the down hole motor. The power section 18 generally includes a housing 22 that houses a motor stator 24 within which a motor rotor 26 is rotationally mounted. The power section 18 converts hydraulic energy into rotational energy by reverse application of the Moineau pump principle. The stator 24 has a plurality of helical lobes, 24*a*-24*e*, which define a corresponding number of helical cavities, 24*a*'-24*e*'. The rotor 26 has a plurality of lobes, 26*a*-26*d*, which number one fewer than the stator lobes and which define a corresponding plurality of helical cavities 26*a*'-26*d*'.

Generally, the greater the number of lobes on the rotor and stator, the greater the torque generated by the motor. Fewer lobes will generate less torque but will permit the rotor to rotate at a higher speed. The torque output by the motor is also dependent on the number of "stages" of the motor, a "stage" being one complete spiral of the stator helix.

In state-of-the-art motors, the stator 24 is made of an elastomeric lining that is molded into the bore of the housing 22. The rotor and stator are usually dimensioned to form a positive interference fit under expected operating conditions, as shown at 25 in prior art FIG. 4. The rotor 26 and stator 24 thereby form continuous seals along their matching contact points that define a number of progressive helical cavities.

When drilling fluid (mud) is forced under pressure through these cavities, it causes the rotor 26 to rotate relative to the stator 24. The interference fit 25 is defined by the difference between the mean diameter of the rotor 26 and the minor diameter of the stator 24 (diameter of a circle inscribed by the stator lobe peaks). Motors that have a positive interference fit of more than about 0.559 millimeters (0.022 inches) are very strong (capable of producing large pressure drops) under down hole conditions. However, a large positive interference fit will provoke an early motor failure. This failure mode is commonly referred to as "chunking".

In practice, the magnitude of the interference fit (at the time of assembly) is dictated by the expected temperature of the drilling fluid and down hole pressure. High temperatures will cause the elastomeric stator of a motor with negative or zero interference fit to expand and form a positive interference fit. For use at lower temperatures, it may be necessary to assemble the motor with a positive interference fit. As mentioned above, a motor with excessive interference fit will fail early. On the other hand, a motor with insufficient interference fit will be a weak motor that stalls at relatively low differential pressure. A motor stalls when the torque required to turn the drill bit is greater than the torque produced by the motor. When this happens, mud is pumped across the seal faces between the rotor and the stator. The lobe profile of the stator must then deform for the fluid to pass across the seal faces. This results in very high fluid velocity across the deformed stator lobes.

In addition to temperature, certain types of drilling fluids may have an adverse effect on the operation of the drilling motor. For example, certain types of oil-based drilling fluid and drilling fluid additives can cause elastomeric stators to swell and become weak. Therefore, the composition of the drilling fluid must also be considered when choosing a motor with the appropriate amount of interference fit.

Those skilled in the art will appreciate that the elastomeric stator of drilling motors is a vulnerable component and is responsible for many motor failures. However, it is generally accepted that either or both the rotor and stator must be made compliant in order to form a hydraulic seal.

Accordingly, what is needed in the art is a drilling motor stator that does not suffer from the deficiencies of the prior art.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE PREFERRED EMBODIMENT

Figure 5:
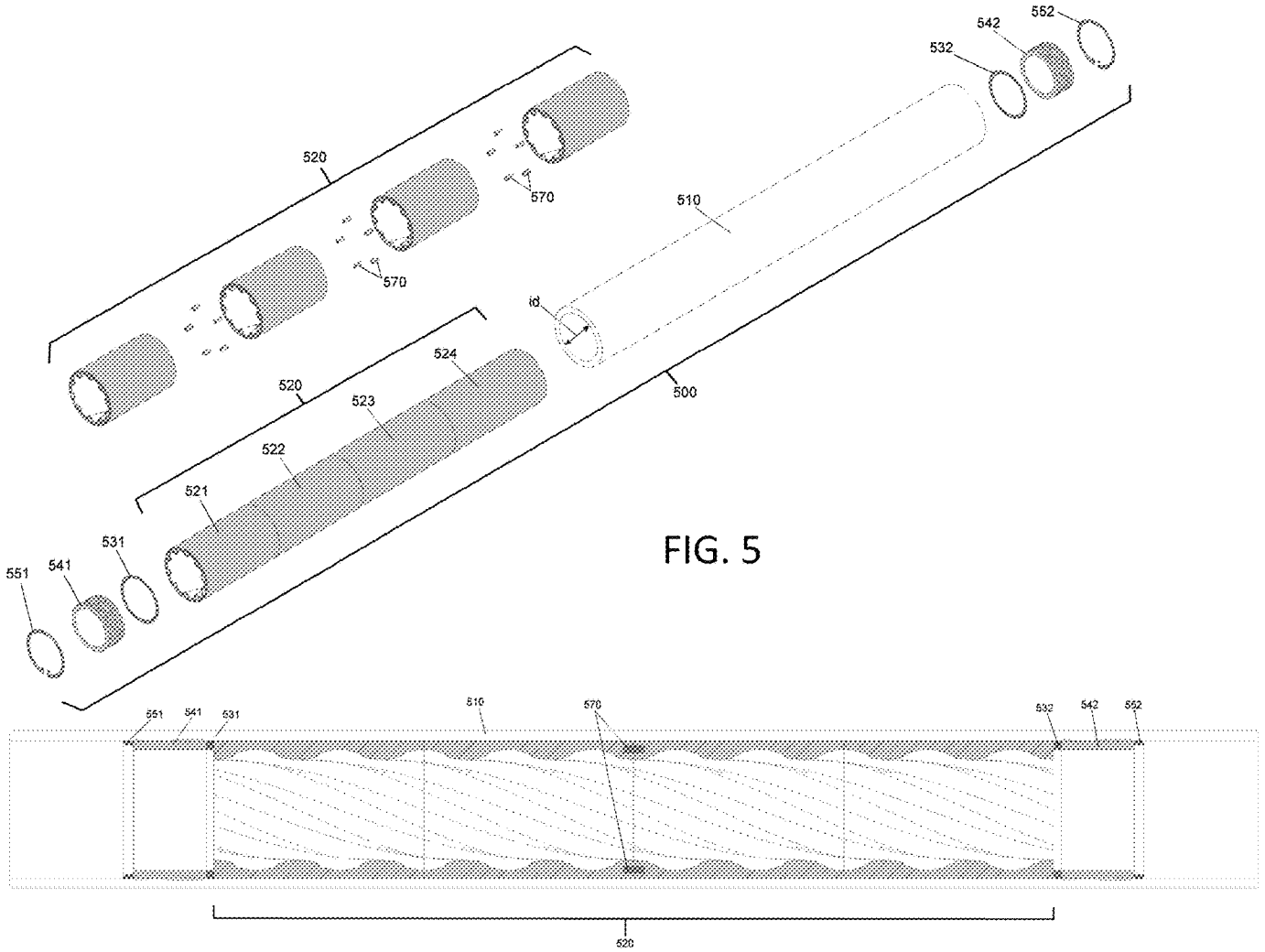
FIG. 5 illustrates a down hole motor stator assembly according to the present disclosure.

To address the above-discussed deficiencies of the prior art, the present disclosure provides a method of manufacturing a down hole motor stator and the product thereof: a down hole motor stator manufactured by that process. Refer now to FIG. 5. To this end, a down hole motor 500 comprising a stator tube 510; a plurality of stator slugs 520; first and second slip washers 531, 532, respectively; first and second threaded compression rings 541, 542, respectively; and first and second snap rings 551, 552, respectively; is provided. A longitudinal cross section of the assembled down hole motor 500 is also shown in FIG. 5.

Figure 6A:
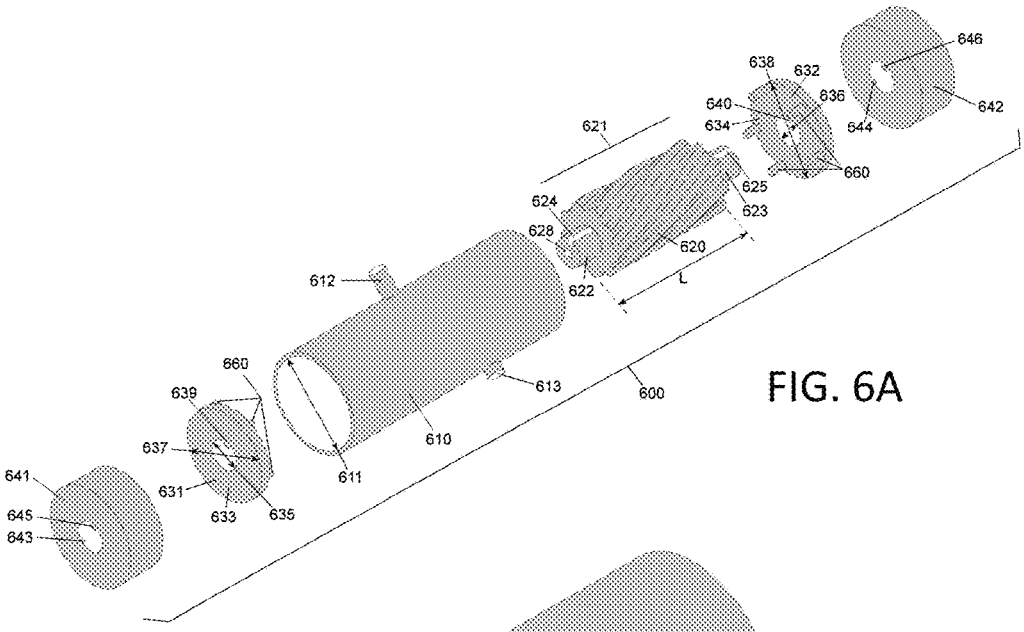
FIG. 6A illustrates a mold system comprising a mold housing, a mold core, and first and second end caps.
Figure 6B:
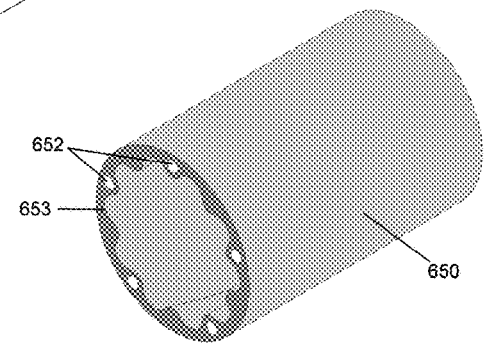
FIG. 6B illustrates a motor stator slug as formed from the mold of FIG. 6A.
Figure 6B:
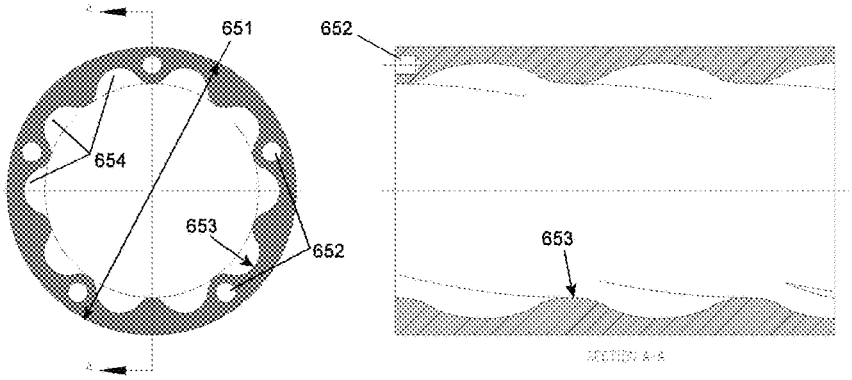

Referring now also to FIGS. 6A and 6B, the mold system 600 comprises: a mold housing 610; a core 620; first and second alignment disks 631, 632, respectively; and first and second end caps 641, 642, respectively.

The mold housing 610 may have an inner diameter 611 slightly smaller than the inner diameter (ID) of the stator tube 510 (See FIG. 5) for which the molded stator slugs 650 are intended, in order to facilitate final motor assembly. Alternatively, the stator slug 650 may be machined to a desired outer diameter after forming. In one embodiment, the inner diameter 611 of the mold housing 610 is slightly smaller in diameter than the intended down hole motor housing (stator tube) 510. The mold housing inner diameter 611 relative to the inner diameter id of the intended stator tube 510 will be determined by prototyping. The required outer diameter 651 of the stator slug 650 may be dependent on the number of slugs in the finished motor 500. The mold housing 610 may further comprise an injection port 612 and a relief port 613.

The mold core 620 has a mold functional portion 621; first and second end central shafts 622, 623, respectively; and first and second alignment slots 624, 625, respectively. It is advantageous that the mold system 600 produces one full cycle (or stage) of the stator for the intended down hole motor 500. A "stage" is one complete spiral of the stator helix. Thus, the mold core 620 will have a functional portion length l equal to one full cycle of the intended stator. The functional portion 621 must be in the form of the void that will be left when the final motor stator slug 650 has been formed, typically having n+1, e.g., ten, lobes when the final motor rotor has n, i.e., nine (9), lobes. This is necessary to employ the reverse Moineau principle for the down hole motor.

The first and second alignment disks 631, 632, respectively, are substantially first and second washer bodies 633, 634, respectively, having an inner diameter 635, 636, respectively, to fit closely around the first and second end central shafts 622, 623, respectively, and an outer diameter 637, 638 to fit closely inside the mold housing 610. The first and second alignment disks 631, 632, respectively, may further comprise index tabs 639, 640, respectively, extending radially inwardly into the washer hole from the first and second washer bodies 633, 634, respectively. The first and second alignment disks 631, 632, respectively, further comprise a plurality of mold pins 660 extending longitudinally from the inner face of each of the first and second washer bodies 633, 634. The plurality of mold pins 660 is spaced apart so that each pin fits between adjacent flutes of the mold functional portion 621. This location of the pins 660 is assured by predefining the angular relationship of the pins 660 to the index tabs 639, 640 and the first and second alignment slots 624, 625, respectively. The plurality of mold pins 660 will create spaced-apart alignment apertures 652 in each end of the final motor stator slugs 650.

First and second end caps 641, 642 for the ends of the mold system 600 are provided. Each of the first and second end caps 641, 642, respectively, further may have first and second central apertures 643, 644, respectively, therein for receiving the first and second end central shafts 622, 623, respectively, of the core 620 therein. The end caps 641, 642 may be a slip fit over the first and second end central shafts 622, 623, respectively, and inside the mold housing 610 to be held in place during molding by clamps or a fixture (not shown). The end caps 641, 642 may further comprise internal tabs 645, 646, respectively, extending radially-inward to cooperate with the grooves 624, 625 of the central shafts 622, 623. In an alternative embodiment, the end caps 641, 642 may not have through-apertures 643, 644, but rather may be partial apertures and therefore have closed ends. Additional seals may be required in the mold system 600 not specifically noted herein but that are within the knowledge of one who is skilled in the art.

The inner surface of the mold housing 610, the outer surface of the core 620, as well as inner surfaces of the first and second alignment disks 631, 632, respectively, may be coated with a parting fluid (not shown) prior to injection of the forming gel (not shown). This will ease removal of the core 620 from the finished stator slug 650 and the slug 650 from the mold housing 610.

Figure 1:
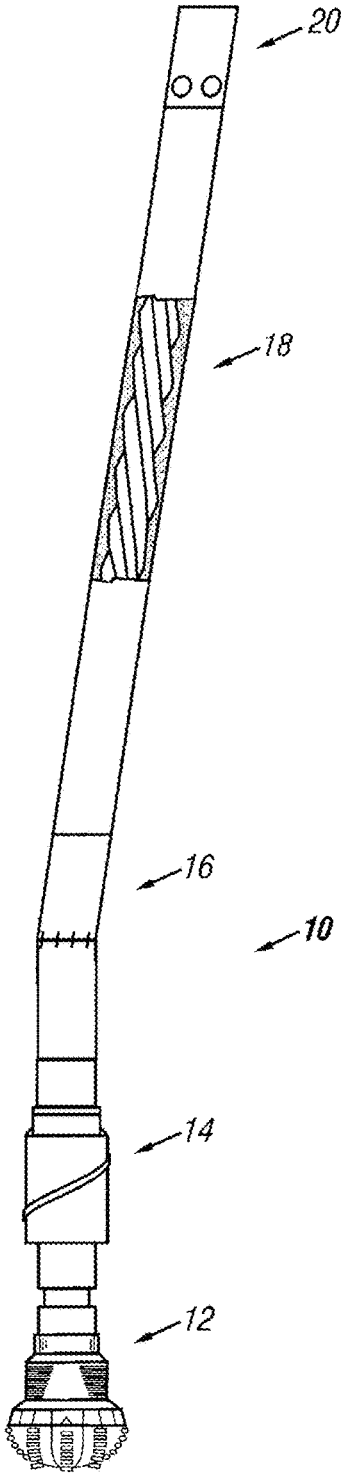
FIG. 1 (Prior Art)
FIG. 1 illustrates a conventional state-of-the-art down hole motor assembly.
Figure 2:
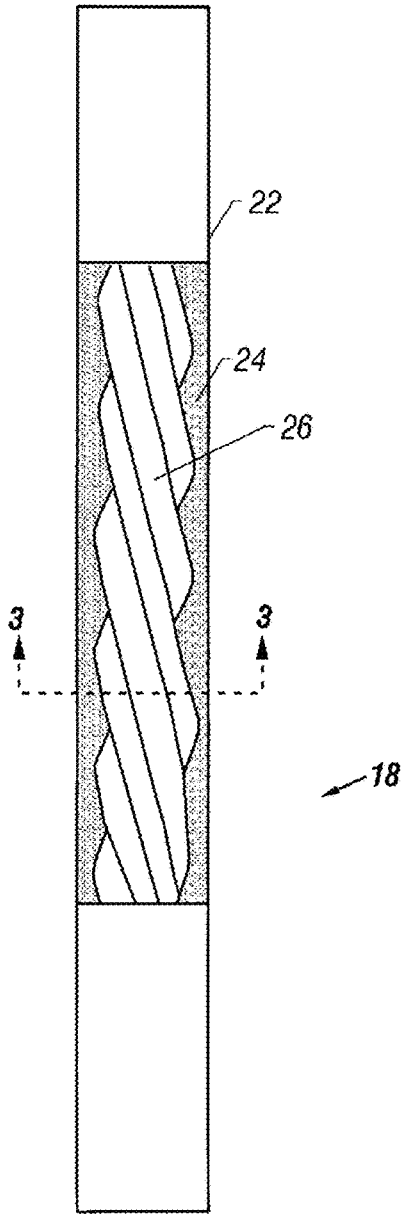
FIG. 2 (Prior Art)
FIG. 2 illustrates details of the power section 18 of the down hole motor.
Figure 4:
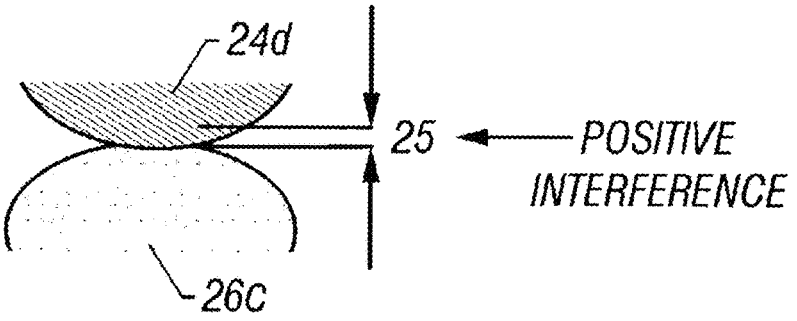
FIG. 4 (Prior Art)
FIG. 4 illustrates a positive interference fit of an elastomeric lining that is molded into the bore of the housing.
Figure 3:
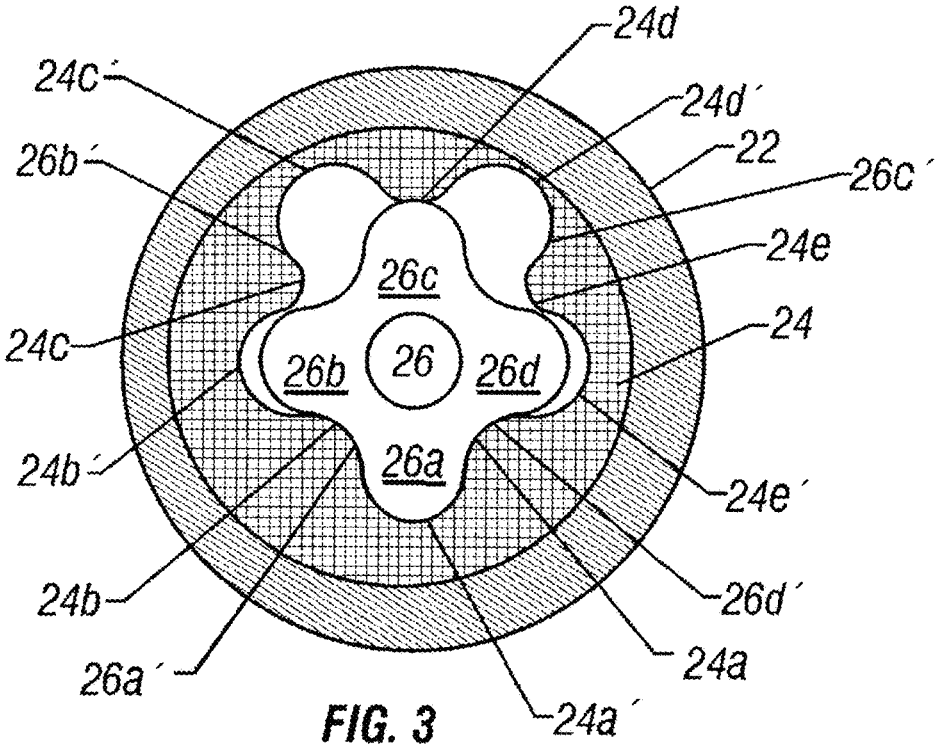
FIG. 3 (Prior Art)
FIG. 3 illustrates further details of the power section 18 of the down hole motor.

The manufacturing process comprises forming the plurality of discrete stator slugs 650 within the mold system 600 outside of the stator tube 510 and then assembling the stator slugs 650 and stator tube 510 into a finished motor 500. Refer again to FIGS. 6A and 6B. A plurality of discrete stator slugs 650 is formed using the mold system 600. Each stator slug 650 is formed by injecting a form-in-place polymer, e.g., a polymeric material comprising a high molecular weight, high density polyethylene (HMW-HDPE) and/or composite through injection port 612 into the mold system 600. Excess polymer exits the mold system 600 through relief port 613 to assure complete filling of the mold 600. While a final motor rotor 26 (See FIGS. 2 and 3) may have n lobes, e.g., nine (9) lobes, the inner core 620 that shapes the motor stator inner surface 653 must have n+1 lobes, i.e., ten (10) lobes, to form the required corresponding ten (10) cavities 654 in the motor stator surface 653 of the reverse Moineau-principle motor.

Because of the physical nature of the core 620 having 10 spiral lobes, the core 620 will have to be rotated with respect to the formed stator slug 650 in order to be removed after each stator slug is formed and cured. Therefore, the core 620 may have a recessed socket 628 in an end thereof so that the core 620 may be un-screwed from the slug 650 with a suitable tool before the slug 650 is removed from the mold housing 610. A pushing ram (not shown) may be required to force the finished slug 650 from the mold housing 610. Such a device is within the knowledge of one who is of skill in the art. The preferred order of removal of the core 620 from the slug 650 and the slug 650 from the mold housing 610 may be determined by experimentation.

Multiple castings from the mold system 600 may be made to assemble the desired number of stages for a given motor. For ease of manufacturing, the number of stator slugs 650 to be used in a specific motor may equal the number of stages to be desired in the final motor, where a "stage" is one complete spiral of the stator helix. That is, where the number of stages is m, e.g., four (4), then four discrete stator slugs 650 (see also 521-524) would be used in the finished stator 520. (See FIG. 5) Thus, with the mold system 600 producing a full cycle of the stator 520 of the down hole motor 500, it is easy to extend the stator for any number of cycles desired in the final motor stator by adding additional discrete products from the mold system 600. The slugs 650 may further be machined to final dimensions before stator assembly.

MOTOR ASSEMBLY. Refer now back to FIG. 5. The motor stator 520 is formed with the required number of sections (slugs 650) 521-524. A plurality of alignment pins 570 is inserted into alignment apertures 652 as shown. Of course, alternatively, the alignment apertures and pins may be replaced, with suitable provisions in the mold, with any suitable indexing method to assure the motor cycles are continuous. The slugs 521-524 are then assembled sequentially inside the steel stator tube 510, i.e., a down hole motor housing. One method of assembly is: the second slip washer 532 may be assembled to the last slug 524, then the last slug 524 is inserted into the stator tube 510. The slugs 520 may require external lubricant during assembly. The third slug 523 is then assembled to the last slug 524 using the alignment pins 570 to align the two slugs 523, 524. The third slug 523 is then slid into the stator tube 510, etc. This procedure is then followed until the first slug 521 is inserted into the stator tube 510 and the first slip washer 531 is assembled to the first slug 521. The first and second threaded compression rings 541, 542, respectively, are inserted and the first threaded compression ring 541 is seated to the desired depth and the first snap ring 551 is placed in the stator tube 510. The second threaded compression ring 542 is then torqued to the desired value, thereby intentionally compressing the stator slugs 520. Lubrication may also be required on the compression-ring side of the first and second slip washers 531, 532 to prevent deformation of the first and fourth slugs 521, 524 during threaded compression ring seating. The second snap ring 552 is then set in place to prevent the second threaded compression ring 542 from backing off. One who is skilled in the art will readily understand the threaded compression ring and snap ring arrangement disclosed and possibly design other methods for retention of the motor portions. The threaded compression ring and snap ring retention finishes the forming of the down hole motor stator. Of course, one who is of skill in the art will readily design alternative sequences of assembly that remain within the scope of the present disclosure.

The mold system 600 may alternatively be divided into two half-cycle systems for convenience of molding should the molding of full cycles be unwieldy. In this embodiment, each core 621 will constitute one-half of a cycle. The procedure for forming the half-cycle slugs and for assembly of the motor stator parallels the above description.

Figure 7:
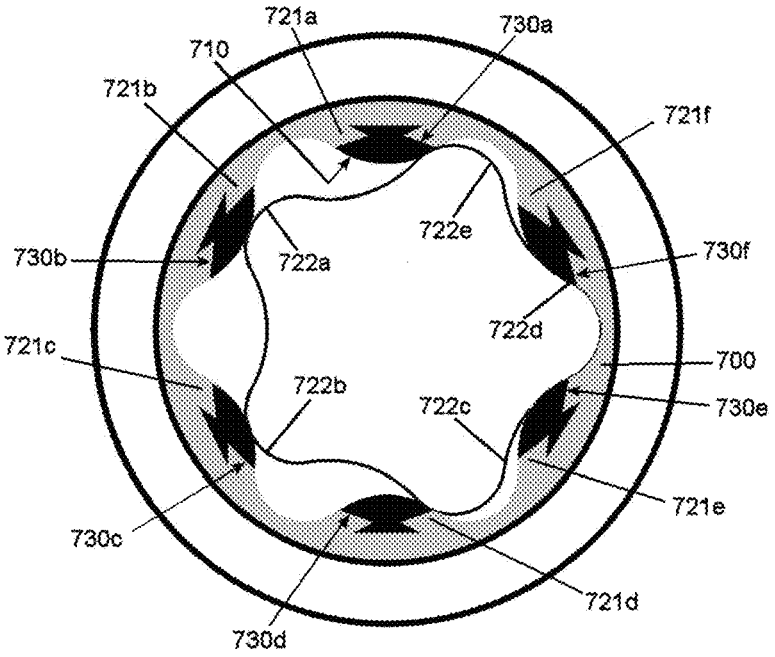
FIG. 7 illustrates a cross section of a motor stator showing a replaceable stator lip.

Referring now to FIG. 7, illustrated is a cross section of a motor stator 700 showing an example of a replaceable stator lip 710. In one embodiment, the lip 710 of the stator lobes 721*a*-721*f* may be affixed with rubber inserts 730*a*-730*f*. This embodiment may be useful when positive interference is desired with the motor rotor. Design of the mold core 620 of FIG. 6A may be such that the rubber insert 730*a*-730*e* is replaceable, thereby extending the useable lifetime of the motor stator 700. One who is of skill in the art is familiar with how a replaceable lip may be designed into the mold core 620. Furthermore, with the presently disclosed assembly, the final motor stator may be readily disassembled for replacement of the rubber insert 730*a*-730*e* in contrast to the prior art wherein the stator is formed entirely within the stator tube and is not removable without destruction.

Figure 8:
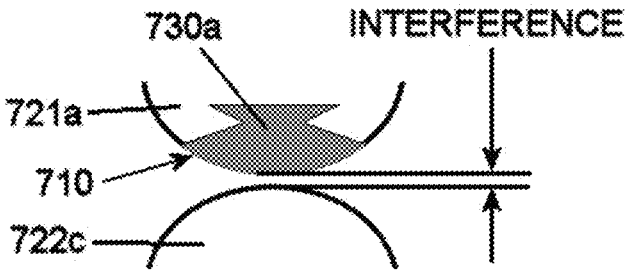
FIG. 8 illustrates a cross section illustrating negative interference.

Refer now to FIG. 8 with continuing reference to FIG. 7. In one embodiment, the stator lobes 721*a*-721*f* formed hereby and the rotor lobes may have a positive or a negative interference as shown by representative stator lobe 721*a* and rotor lobe 722*c*. That is, a positive interference such that there is no gap between the stator lobes 721*a*-721*f* and rotor lobes 722*a*-722*e* or a negative interference, such that there is a designed gap between the stator lobes 721*a*-721*f* and rotor lobes 722*a*-722*e*. With the interference kept to a precise limit by use of the replaceable rubber inserts, this configuration will increase the efficiency and power output of the down hole motor and reduce wear to the motor stator. It should be noted that the amount of interference of a particular motor may be varied by changing the diameter of the core 620 in the mold system 600 or by changing the dimensions of the rubber inserts 721*a*-721*f* in an embodiment employing changeable inserts.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A modular down hole motor assembly component comprising:

a first stator slug having a first stator slug exterior surface configured for telescopic positioning within a stator housing;

said first stator slug exterior surface further configured for relative juxtaposition with one or more additional stator slug exterior surfaces to form, an elongate stator assembly within said stator housing;

said first stator slug having a first interior slug space configured for defining first stator slug helical lobes and corresponding first stator slug helical cavities for interaction with correspondingly configured rotor helical lobes and rotor helical cavities of a rotor for facilitating rotation of said rotor under force of fluid forced through said first stator slug helical cavities and said rotor helical cavities;

said first stator slug being cast from a polymeric material; and at least one replaceable, fitted insert removably attached to said first stator slug helical lobes adjacent to said corresponding rotor helical cavities to form a modular stator surface assembly.

2. The assembly of claim 1 further comprising a second stator slug having a second stator slug exterior surface configured for telescopic positioning within the stator housing;

said second stator slug exterior surface further configured for relative juxtaposition with said first stator slug exterior surface to form, the elongate stator assembly; and said second stator slug having a second interior slug space configured for defining second stator slug helical lobes and corresponding second stator slug helical cavities for interaction with correspondingly configured rotor helical lobes and rotor helical cavities of a rotor for facilitating rotation of said rotor under force of fluid forced through said second stator slug helical cavities and said rotor helical cavities.

3. A method for manufacturing a modular down hole motor component comprising the steps of:

fabricating a first stator dug;

said first stator slug having a first stator slug exterior surface configured for telescopic positioning within a stator housing;

said first stator slug exterior surface further configured for relative juxtaposition with one or more additional stator slug exterior surfaces to form, an elongate stator assembly within said stator housing;

said first stator slug having a first interior slug space configured for defining first stator slug helical lobes and corresponding first stator slug helical cavities for interaction with correspondingly configured rotor helical lobes and rotor helical cavities of a rotor for facilitating rotation of said rotor under force of fluid forced through said first stator slug helical cavities and said rotor helical cavities;

said first stator slug being cast from a polymeric material; and at least one replaceable, fitted insert removably attached to said first stator slug helical lobes adjacent to said corresponding rotor helical cavities to form a modular stator surface assembly.

4. A method for manufacturing a modular down hole motor assembly comprising the steps of:

fabricating a first stator slug;

said first stator slug having a first stator slug exterior surface configured for telescopic positioning within a stator housing;

said first stator slug exterior surface further configured for relative juxtaposition with one or more additional stator slug exterior surfaces to form, an elongate stator assembly within said stator housing;

said first stator slug having a first interior slug space configured for defining first stator slug helical lobes and corresponding first stator slug helical cavities for interaction with correspondingly configured rotor helical lobes and rotor helical cavities of a rotor for facilitating rotation of said rotor under force of fluid forced through said first stator slug helical cavities and said rotor helical cavities;

said first stator slug being cast from a polymeric material;

fabricating a second stator slug;

said second stator slug having a second stator slug exterior surface configured for telescopic positioning within the stator housing;

said second stator slug exterior surface further configured for relative juxtaposition with said one or more additional stator slug exterior surfaces to form, the elongate stator assembly within the stator housing;

said second stator slug having a second interior slug space configured for defining second stator slug helical lobes and corresponding second stator slug helical cavities for interaction with correspondingly configured rotor helical lobes and rotor helical cavities of a rotor for facilitating rotation of said rotor under force of fluid forced through said second stator slug helical cavities and said rotor helical cavities;

selecting a stator housing that defines an interior stator housing space for telescopically receiving said first and second stator slugs; and inserting said first and second stator slugs within said interior stator housing space of said stator housing, and securing said first and second stator slugs within said interior stator housing space of said stator housing through use of securing means.

5. The method of claim 4 wherein said second stator slug being cast from a polymeric material.

6. The method of claim 4 wherein at least one replaceable, fitted insert is removably attached to said first stator slug helical lobes adjacent to said corresponding rotor helical cavities to form a modular stator surface assembly.

7. The method of claim 5 wherein at least one replaceable, fitted insert is removably attached to said first stator slug helical lobes adjacent to said corresponding rotor helical cavities to form a modular stator surface assembly.

* * * * *